US006719292B2

(12) United States Patent
Lo

(10) Patent No.: US 6,719,292 B2
(45) **Date of Patent: *Apr. 13, 2004**

(54) CARD GAME

(76) Inventor: Henry Tien Lo, 5010 Indian River Dr., #32 L.V., NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 09/823,565

(22) Filed: Mar. 29, 2001

(65) Prior Publication Data

US 2002/0063388 A1 May 30, 2002

Related U.S. Application Data

(60) Provisional application No. 60/193,309, filed on Mar. 30, 2000.

(51) Int. Cl.[7] ..... A63F 1/00; A63F 9/20
(52) U.S. Cl. ..... 273/292; 273/274; 463/12
(58) Field of Search ..... 273/292, 274; 463/10–13

(56) References Cited

U.S. PATENT DOCUMENTS

| | | | | | |
|---|---|---|---|---|---|
| 5,489,101 | A | * | 2/1996 | Moody | 273/292 |
| 5,794,934 | A | * | 8/1998 | Malcolm | 273/292 |
| 5,868,392 | A | * | 2/1999 | Kraft | 273/292 |
| 5,951,012 | A | * | 9/1999 | Feola | 273/292 |
| 5,984,310 | A | * | 11/1999 | English | 273/292 |
| 6,012,720 | A | * | 1/2000 | Webb | 273/292 |
| 6,019,374 | A | * | 2/2000 | Breeding | 273/292 |
| 6,042,118 | A | * | 3/2000 | Poitra | 273/292 |
| 6,102,402 | A | * | 8/2000 | Scott et al. | 273/292 |
| 6,206,373 | B1 | * | 3/2001 | Garrod | 273/292 |
| 6,402,147 | B1 | * | 6/2002 | Lo | 273/292 |
| 2001/0048197 | A1 | * | 12/2001 | Lo | 273/292 |
| 2001/0050462 | A1 | * | 12/2001 | Lo | 273/292 |
| 2001/0054796 | A1 | * | 12/2001 | Lo | 273/292 |
| 2001/0054797 | A1 | * | 12/2001 | Lo | 273/292 |
| 2002/0024178 | A1 | * | 2/2002 | Lo | 273/292 |
| 2002/0163128 | A1 | * | 11/2002 | Lo | 273/292 |

OTHER PUBLICATIONS

Scarne's Encyclopedia of Games, 1973, pp 6–53.*

* cited by examiner

*Primary Examiner*—Jessica Harrison
*Assistant Examiner*—Alex F. R. P. Rada, II
(74) *Attorney, Agent, or Firm*—Gerry J. Elman; Elman Technology Law, P.C.

(57) ABSTRACT

The invention is an eight-card-stud poker game, played with at least one but preferably one standard poker deck of 52 cards, plus at least one but preferably four Jokers. Two or more but preferably seven players may participate in the game. One of the players is the Banker whom other players play against. A Player who is not a Banker may play Aces Two Pair Or Better Bet, 3 Of A Kind Or Better Bet, Straight Or Better Bet, Flush Or Better Bet, Full House Or Better Bet, 4 Of A Kind Or Better Bet, and/or Bonus Bet betting on the contents of the Player's own hand. After at least one bet is placed, each Player and the Banker are each dealt seven cards and one community card. From each Player's own seven dealt cards and the community card, he selects and keeps his best 5-card poker hand and discards three other cards. To win a bet, the Player's best 5-card poker hand must be one of the predetermining winning hands of the type of the bet he bets on, regardless of the Banker's hand. If a Player makes more than one bet, the Player may win all bets made, the Player may win some bet(s) and lose the other(s), or the Player may lose all bets made.

17 Claims, 3 Drawing Sheets

CARD GAME

CROSS REFERENCE TO RELATED APPLICATION

This application claims priority under 35 U.S.C. 119(e) from the part 11 "Wild Card Thrill" of the following U.S. provisional patent applications: Ser. No. 60/193,309 filed Mar. 30, 2000, which is incorporated by the reference.

FIELD OF THE INVENTION

The invention generally relates to card games and, in particular, to card games for use in casinos and cardrooms.

SUMMARY OF THE INVENTION

The invention Is offered under the trademark "Wild 8 Card Thrill." The invention Is an eight-card-stub poker game, played with at least one but preferably one standard poker deck of 52 cards, plus at least one but preferably four Jokers. Each Joker can be used as any card. Two or more but preferably seven players may participate in the game. One of the players is the Banker whom other players play against. A Player who is not a Banker may play Aces Two Pair Or Better Bet, 3 Of A Kind Or Better Bet, Straight Or Better Bet, Flush Or Better Bet, Full House Or Better Bet, 4 Of A Kind Or Better Bet, and/or Bonus Bet betting on the contents of the Player's own unseen hand.

After at least one wager is placed, each Player and the Banker are each dealt seven cards and one community card (A community card is a card that is shared by each Player and the Banker). From each Player's seven cards and the community card, each Player selects and keeps his or her best 5-card poker hand and discards three other cards, which are treated as three discards; i.e., from the Player's seven dealt cards QQK9754 and the community card 3, QQK97 is the Player's best 5-card poker hand and 543 are the three discards; from the Player's seven dealt cards KKJJ655 and the community card 2, KKJJ6 is the Player's best 5-card poker hand and 552 are the three discards. The Banker's hand does not play.

ACES TWO PAIR OR BETTER BET: A Player's Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush; the wager loses if the Player's best 5-card poker hand is not one of the above winning hands. Aces Two Pair Or Better Bet pays Even Money (1 to 1) on any one of the above winning hands. Alternatively, any other appropriate payout odds can be used.

3 OF KIND OR BETTER BET: A Player's 3 Of A Kind Or Better Bet wager wins if the Player's best 5-card poker hand is 3 of a Kind, Straight, Flush, Full House, 4 of a Kind, Straight Flush, 5 of a Kind or Royal Flush; and the wager loses if the Player's best 5-card poker hand is not one of the above winning hands. 3 Of A Kind Or Better Bet pays Even Money (1 to 1) on any one of the above winning hands. Alternatively, any other appropriate payout odds can be used.

STRAIGHT OR BETTER BET: A Player's Straight Or Better Bet wager wins if the Player's best 5-card poker hand is Straight, Flush, Full House, 4 of a Kind, Straight Flush, 5 of a Kind or Royal Flush; and the wager loses if the Player's best 5-card poker hand is not one of the above winning hands. Straight Or Better Bet pays 2 to 1 on any one of the above winning hands. Alternatively, any other appropriate payout odds can be used.

FLUSH OR BETTER BET: A Player's Flush Or Better Bet wager wins if the Player's best 5-card poker hand is Flush, Full House, 4 of a Kind, Straight Flush, 5 of a Kind or Royal Flush; and the wager loses if the Player's best 5-card poker hand is not one of the above winning hands. Flush Or Better Bet pays 4 to 1 on any one of the above winning hands. Alternatively, any other appropriate payout odds can be used.

FULL HOUSE OR BETTER BET: A Player's Full House Or Better Bet wager wins if the Player's best 5-card poker hand is Full House, 4 of a Kind, Straight Flush, 5 of a Kind or Royal Flush; and the wager loses if the Player's best 5-card poker hand is not one of the above winning hands. Full House or Better Bet pays 6 to 1 on any one of the above winning hands. Alternatively, any other appropriate payout odds can be used.

4 OF A KIND OR BETTER BET: A Player's 4 Of A Kind Or Better Bet wager wins if the Player's best 5-card poker hand is 4 of a Kind, Straight Flush, 5 of a Kind or Royal Flush; the wager loses if the Player's best 5-card poker hand is not one of the above winning hands. 4 Of A Kind Or Better Bet pays 12 to 1 on any one of the above winning hands. Alternatively, any other appropriate payout odds can be used.

BONUS BET: Either one of the following three types of games can be used for Bonus Bet game:

Game 1: A Player's Bonus Bet wager wins if the player's best 5-card poker hand is Full House, 4 of a Kind, Straight Flush, 5 of a Kind, Wild Royal Flush (Royal Flush with one or more Jokers) or Natural Royal Flush (Royal Flush with no Joker); and the wager loses if the Player's best 5-card poker hand is not one of the above winning hands. The winning wager is paid according to the pay table below:

| Hand | Payout Odds |
|---|---|
| Natural Royal Flush | 1,000 to 1 |
| Wild Royal Flush | 45 to 1 |
| 5 of a Kind | 30 to 1 |
| Straight Flush | 15 to 1 |
| 4 of a Kind | 3 to 1 |
| Full House | 2 to 1 |

Alternatively, any other appropriate pay table can be used.

Game 2; A Player's Bonus Bet wager wins if the Player's best 5-card poker hand is 4 of a Kind, Straight Flush, 5 of a Kind, Wild Royal Flush or Natural Royal Flush; and the wager loses if the Player's best 5-card poker hand is not one of the above winning hands. The winning wager is paid according to the pay table below:

| Hand | Payout Odds |
|---|---|
| Natural Royal Flush | 1,000 to 1 |
| Wild Royal Flush | 100 to 1 |
| 5 of a Kind | 30 to 1 |
| Straight Flush | 15 to 1 |
| 4 of a Kind | 4 to 1 |

Alternatively, any other appropriate pay table can be used.

Once the dealer has delivered the cards to all players, the dealer puts away the Banker's seven cards in the discard holder. After reading their cards, each Player places his or her cards face down on the appropriate spaces of the table layout. The dealer then opens each Player's cards and settles each Player's wager(s) against the Banker.

DETAILED DESCRIPTION OF THE INVENTION

Figure 1:
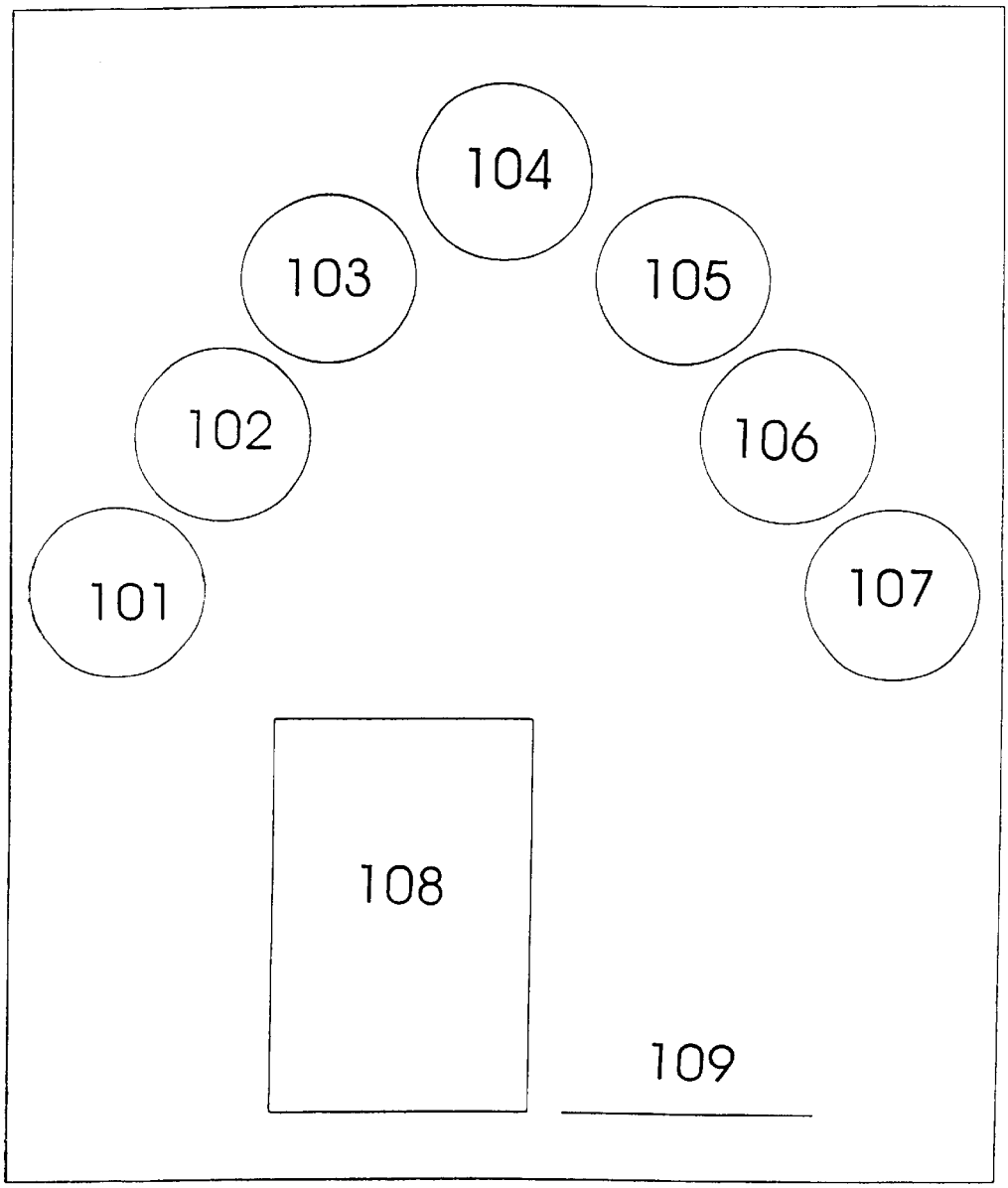
FIG. 1 shows a Player's betting area of the table layout of the seven-bet version of the invention: 101 is Aces Two Pair Or Better Bet spot; 102, 3 Of A Kind Or Better Bet spot; 103, Straight Or Better Bet spot; 104, Flush Or Better Bet spot; 105, Full House Or Better Bet spot; 106, 4 Of A Kind Or Better Bet spot; 107, Bonus Bet spot; 108, a Player's hand space; and 109, a Player's discards space.
Figure 2:
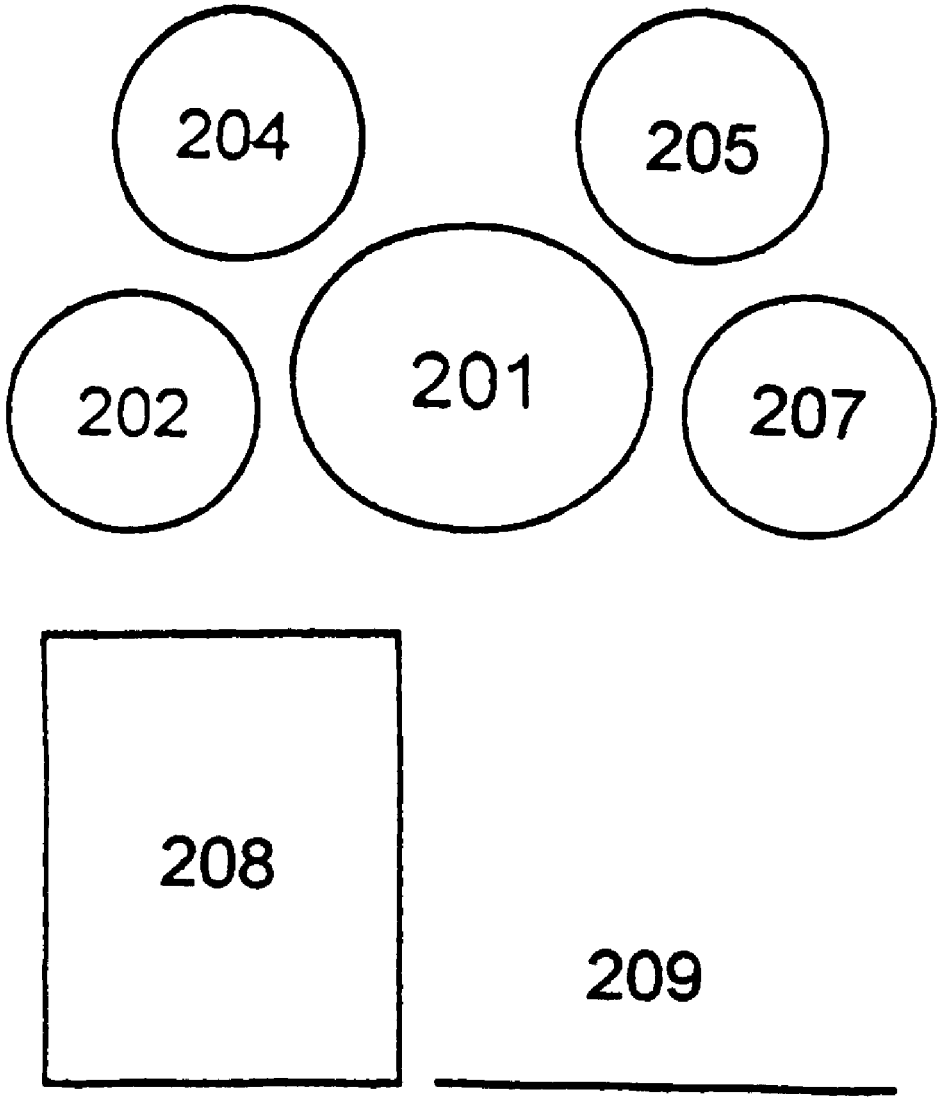
FIG. 2 shows a Player's betting area of the table layout of the five-bet version of the invention: 201 is Aces Two Pair Or Better Bet spot; 202, 3 Of A Kind Or Better Bet spot; 205, Full House Or Better Bet spot; 207, Bonus Bet spot; 208, a Player's hand space; 209, a Player's discards space.
Figure 3:
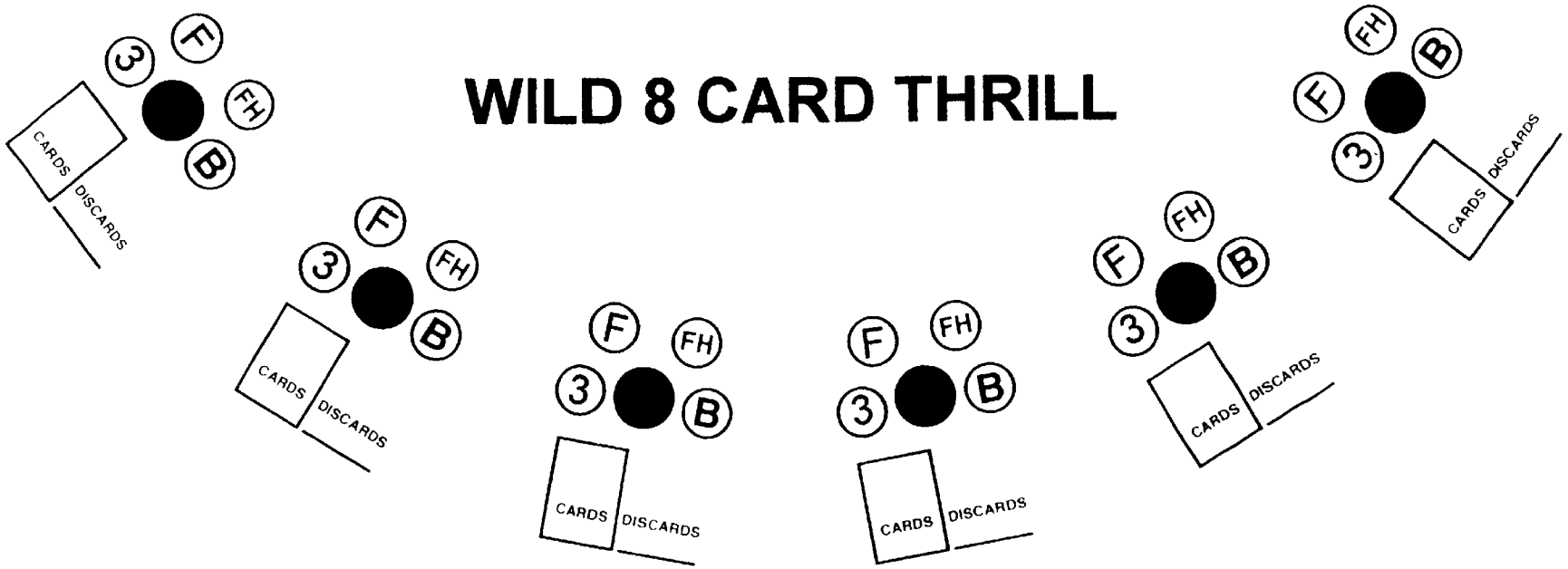
FIG. 3 shows a table layout of the five-bet version of the invention.

The preferred embodiment of the invention provides an eight-card-stud poker game, played with one standard poker deck of 52 cards plus four Jokers. In an embodiment, the invention is played with at least one standard poker deck of 52 cards plus at least one Joker. In an embodiment, the invention Is played with at least one standard poker deck of 52 cards, wherein either all Twos, all Threes, all Fours, all Fives, all Sixes, all Sevens, all Eights, all Nines, all Tens, all Jacks, all Queens, all Kings, or all Aces are Wild Cards.

In the preferred embodiment, each Joker or each Wild Card can be used as any card to form a pair, 3 of a Kind, Straight, Flush, Full House, 4 of a Kind, Straight Flush, 5 of a Kind or Royal Flush. In an embodiment, each Joker or each Wild Card can be used as an Ace, or to form a Straight or Flush.

In the preferred embodiment, table size, management of players, players' bets, and speed of play are the key reasons for the invention to offer seven positions: six Players and one Banker; each Player plays against the Banker. In other embodiments, lesser or greater than seven players can be created in accordance with the invention if, for example, multiple decks are used.

A Player who is not a Banker may play Aces Two Pair Or Better Bet, 3 Of A Kind Or Better Bet, Straight Or Better Bet, Flush Or Better Bet, Full House Or Better Bet, 4 Of A Kind Or Better Bet, and/or Bonus Bet betting on the contents of the Player's own unseen hand. After at least one wager is placed, each Player and the Banker are each dealt seven cards first, and then one community card is dealt either face up or face down (whichever option is selected) at any appropriate space of the table layout, preferably at the center of the table layout, starting from the Player sitting to the immediate left of the dealer, continuing in a clockwise fashion and ending with the Banker. Cards are preferably dealt to each Player and to the Banker one card at a time for seven times if the cards are shuffled by a dealer; the cards are preferably dealt to each Player and to the Banker in a stack of seven cards if the cards are shuffled by a shuffling device. Alternatively, seven hands of seven cards are always dealt first and then one community card is dealt face up, regardless of the actual number of players; and some random number generation device such as a random number generator display or a dice shaker, is used to assign the dealt hands to players to reduce the likelihood of problems in dealing. In other embodiments, each Player and the Banker can receive their hands in either one of the following ways, whichever is selected for the game:

1. They receive their own eight cards and no community card.
2. They receive their own six cards and two community cards.
3. They receive their own five cards and three community cards.
4. They receive their own four cards and four community cards.
5. They receive their own three cards and five community cards.
6. They receive their own two cards and six community cards.
7. They receive their own one card and seven community cards. And
8. They receive no card their own and eight community cards.

Once having delivered the cards to all players, the dealer put the Banker's seven cards in the discard holder. From each Player's own seven cards and the community card, each Player selects and keeps his or her best 5-card poker hand, and discards three other cards, then each Player places his or her cards on the appropriate spaces of the table layout. The dealer then opens the cards of the Player at the immediate right of the dealer, and settles the Player's wager(s) against the Banker. After completing the transaction of the Player at the immediate right of the dealer, the dealer moves on and completes the transaction of the next Player, and so on. Upon the completion of all transactions, a new round of play will begin.

ACES TWO PAIR OR BETTER BET: A Player's Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush; the wager loses if the Player's best 5-card poker hand is not one of the above winning hands. Aces Two Pair Or Better Bet pays Even Money (1 to 1) on any one of the above winning hands. Alternatively, any other appropriate payout odds can be used.

3 OF KIND OR BETTER BET: A Player's 3 Of A Kind Or Better Bet wager wins if the Player's best 5-card poker hand is 3 of a Kind, Straight, Flush, Full House, 4 of a Kind, Straight Flush, 5 of a Kind or Royal Flush; and the wager loses if the Player's best 5-card poker hand is not one of the above winning hands. 3 Of A Kind Or Better Bet pays Even Money (1 to 1) on any one of the above winning hands. Alternatively, any other appropriate payout odds can be used.

STRAIGHT OR BETTER BET: A Player's Straight Or Better Bet wager wins if the Player's best 5-card poker hand is Straight, Flush, Full House, 4 of a Kind, Straight Flush, 5 of a Kind or Royal Flush; and the wager loses if the Player's best 5-card poker hand is not one of the above winning hands. Straight Or Better Bet pays 2 to 1 on any one of the above winning hands. Alternatively, any other appropriate payout odds can be used.

FLUSH OR BETTER BET: A Player's Flush Or Better Bet wager wins if the Player's best 5-card poker hand is Flush, Full House, 4 of a Kind, Straight Flush, 5 of a Kind or Royal Flush; and the wager loses if the Player's best 5-card poker hand is not one of the above winning hands. Flush Or Better Bet pays 4 to 1 on any one of the above winning hands. Alternatively, any other appropriate payout odds can be used.

FULL HOUSE OR BETTER BET: A Player's Full House Or Better Bet wager wins if the Player's best 5-card poker hand is Full House, 4 of a Kind, Straight Flush, 5 of a Kind or Royal Flush; and the wager loses if the Player's best 5-card poker hand is not one of the above winning hands. Full House or Better Bet pays 6 to 1 on any one of the above winning hands. Alternatively, any other appropriate payout odds can be used.

4 OF A KIND OR BETTER BET: A Player's 4 Of A Kind Or Better Bet wager wins if the Player's best 5-card poker hand is 4 of a Kind, Straight Flush, 5 of a Kind or Royal Flush; the wager loses if the Player's best 5-card poker hand is not one of the above winning hands. 4 Of A Kind Or Better Bet pays 12 to 1 on any one of the above winning hands. Alternatively, any other appropriate payout odds can be used.

BONUS BET: Either one of the following three types of games can be used for Bonus Bet game:

Game 1: A Player's Bonus Bet wager wins if the player's best 5-card poker hand is Full House, 4 of a Kind, Straight Flush, 5 of a Kind, Wild Royal Flush (Royal Flush with one or more Jokers) or Natural Royal Flush (Royal Flush with no Joker); and the wager loses if the Player's best 5-card poker hand is not one of the above winning hands. The winning wager is paid according to the pay table below:

| Hand | Payout Odds |
|---|---|
| Natural Royal Flush | 1,000 to 1 |
| Wild Royal Flush | 45 to 1 |
| 5 of a Kind | 30 to 1 |
| Straight Flush | 15 to 1 |
| 4 of a Kind | 3 to 1 |
| Full House | 2 to 1 |

Alternatively, any other appropriate pay table can be used.

Game 2; A Player's Bonus Bet wager wins if the Player's best 5-card poker hand is 4 of a Kind, Straight Flush, 5 of a Kind, Wild Royal Flush or Natural Royal Flush; and the wager loses if the Player's best 5-card poker hand is not one of the above winning hands. The winning wager is paid according to the pay table below:

| Hand | Payout Odds |
|---|---|
| Natural Royal Flush | 1,000 to 1 |
| Wild Royal Flush | 100 to 1 |
| 5 of a Kind | 30 to 1 |
| Straight Flush | 15 to 1 |
| 4 of a Kind | 4 to 1 |

Alternatively, any other appropriate pay table can be used.

Rules regarding the Banker's hand: In the preferred embodiment, each Player and the Banker are each dealt a hand; each Player's hand does play and the Banker's hand does not play since Players are not allowed to bet on the contents of the Banker's hand. In an embodiment, each Player is dealt a hand, but the Banker is dealt no hand. In another embodiment, each Player and the Banker are each dealt a hand; each Player's hand does play and the Banker's hand does play since Players are allowed to bet on the contents of the Banker's hand.

What is claimed is:

1. A method of playing a card game among a plurality of Players and a Banker, each Player wagering against the Banker, the method comprising the following steps:

(a) providing and shuffling at least one standard poker deck of 52 cards plus at least one Joker;

(b) each Player placing at least one wager of Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet;

(c) each Player and the Banker are each dealt seven cards and one community card;

(d) determining which dealt hand is assigned to each Player and which dealt hand is assigned to the Banker;

(e) the dealer putting away the Banker's hand in the discard holder;

(f) from each Player's own seven dealt cards and the community card, he or she selecting his or her best 5-card poker-hand and discarding three other cards;

(g) determining whether each Player's wager or wagers win or lose, wherein each Joker may be used as any card;

wherein a Player's Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush, and is paid according to a predetermined Aces Two Pair Or Better Bet pay table; the player's said wager loses if the Player's best 5-card poker hand is not one of the aforesaid winning hands;

wherein a Player's 3 Of A Kind Or Better Bet wager wins if said Player's best 5-card poker hand is 3 of a Kind, Straight, Flush, Full House, 4 of a Kind, Straight Flush, 5 of a Kind or Royal Flush, and is paid according to a predetermined 3 Of A Kind Or Better Bet pay table; the player's said wager loses if the Player's best 5-card poker hand is not one of the aforesaid winning hands;

wherein a Player's Straight Or Better Bet wager wins if said Player's best 5-card poker hand is Straight, Flush, Full House, 4 of a Kind, Straight Flush, 5 of a Kind or Royal Flush, and is paid according to a predetermined Straight Or Better Bet pay table; the player's said wager loses if the Player's best 5-card poker hand is not one of the aforesaid winning hands;

wherein a Player's Flush Or Better Bet wager wins if said Player's best 5-card poker hand is Flush, Full House, 4 of a Kind, Straight Flush, 5 of a Kind or Royal Flush, and is paid according to a predetermined Flush Or Better Bet pay table; the player's said wager loses if the Player's best 5-card poker hand is not one of the aforesaid winning hands;

wherein a Player's Full House Or Better Bet wager wins if said Player's best 5-card poker hand is Full House, 4 of a Kind, Straight Flush, 5 of a Kind or Royal Flush, and is paid according to a predetermined Full House Or Better Bet pay table; the player's said wager loses if the Player's best 5-card poker hand is not one of the aforesaid winning hands;

wherein a Player's 4 Of A Kind Or Better Bet wager wins if said Player's best 5-card poker hand is 4 of a Kind, Straight, Flush, 5 of a Kind or Royal Flush, and is paid according to a predetermined 4 Of A Kind Or Better Bet pay table; the player's said wager loses if the Player's best 5-card poker hand is not one of the aforesaid winning hands;

wherein a Player's Bonus Bet wager wins if said Player's best 5-card poker hand is one of the predetermined Bonus Bet winning hands, and is paid according to a predetermined Bonus Bet pay table; the player's said wager loses if the Player's best 5-card poker hand is not one of the predetermined Bonus Bet winning hands; and (h) settling each Player's wager or wagers against the Banker.

2. A method of playing a card game among a plurality of Players and a Banker, each Player wagering against the Banker, the method comprising the following steps:

(c) providing and shuffling at least one standard poker deck of 52 cards plus four Jokers;

(d) each Player placing at least one wager of Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet;

(c) each Player and the Banker are each dealt seven cards and one community card;

(e) determining which dealt hand is assigned to each Player and which dealt hand is assigned to the Banker;

(e) the dealer putting away the Banker's hand in the discard holder;

(f) from each Player's own seven dealt card s and the community card , he or she selecting his or her best 5-card poker hand and discarding three other cards;

(g) determining whether each Player's wager or wagers win or lose, wherein each Joker may be used as any card; and (h) settling each Player's wager or wagers against the Banker.

3. The method of playing a card game according to claim 2, wherein Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush; and the wager loses if the Player's best 5-card poker hand is not one of the aforesaid winning hands.

4. The method of playing a card game according to claim 3, wherein Aces Two Pair Or Better Bet pays Even Money, namely 1 to 1, on a hand of Aces Two Pair, 3 of a Kind, Straight, Flush, Full House, 4 of a Kind, Straight Flush, 5 of a Kind or Royal Flush.

5. The method of playing a card game according to claim 2, wherein a Player's3 Of A Kind Or Better Bet wager wins if the Player's best 5-card poker hand is 3 of a Kind, Straight, Flush, Full House, 4 of a Kind, Straight Flush, 5 of a Kind or Royal Flush; and the wager loses if the Player's best 5-card poker hand is not one of the aforesaid winning hands.

6. The method of playing a card game according to claim 5, wherein 3 Of A Kind Or Better Bet pays Even Money, namely 1 to 1, on a hand of 3 of a Kind, Straight, Flush, Full House, 4 of a Kind, Straight Flush, 5 of a Kind or Royal Flush.

7. The method of playing a card game according to claim 2, wherein a Straight Or Better Bet wager wins if the Player's best 5-card poker hand is Straight, Flush, Full House, 4 of a Kind, Straight Flush, 5 of a Kind or Royal Flush; and the wager loses if the Player's best 5-card poker hand is not one of the aforesaid winning hands.

8. The method of playing a card game according to claim 7, wherein Straight Or Better Bet pays 2 to 1 on a hand of Straight, Flush, Full House, 4 of a Kind, Straight Flush, 5 of a Kind or Royal Flush.

9. The method of playing a card game according to claim 2, wherein a Player's Flush Or Better Bet wager wins if the Player's best 5-card poker hand is Flush, Full House, 4 of a Kind, Straight Flush, 5 of a Kind or Royal Flush; the wager loses if the Player's best 5-card poker hand is not one of the aforesaid winning hands.

10. The method of playing a card game according to claim 9, wherein Flush Or Better Bet pays 4 to 1 on a hand of Flush, Full House, 4 of a Kind, Straight Flush, 5 of a Kind or Royal Flush.

11. The method of playing a card game according to claim 2, wherein a Player's Full House Or Better Bet wager wins if the Player's best 5-card poker hand is Full House, 4 of a Kind, Straight Flush, 5 of a Kind, Wild Royal Flush or Natural Royal Flush; and the wager loses if the Player's best 5-card, poker hand is not one of the aforesaid winning hands.

12. The method of playing a card game according to claim 11, wherein Full House Or Better Bet pays 7 to 1 on a hand of Full House, 4 of a Kind, Straight Flush, 5 of a Kind, Wild Royal Flush or Natural Royal Flush.

13. The method of playing a card game according to claim 11, wherein Full House Or Better Bet pays 1,000 to 1 on a hand of Natural Royal Flush, 45 to 1 on a hand of Wild Royal 4Flush, 30 to 1 on a hand of 5 of a Kind, 15 to 1 on a hand of Straight Flush, 3 to 1 on a hand of 4 of a Kind, and 2 to 1 on a hand of Full House.

14. The method of playing a card game according to claim 2, wherein a Player's 4 Of A Kind Or Better Bet wager wins if the Player's best 5-card poker hand is 4 of a Kind, Straight Flush, 5 of a Kind or Royal Flush; and the wager loses if the Player's best 5-card poker hand is not one of the aforesaid winning hands.

15. The method of playing a card game according to claim 14, wherein 4 Of A Kind Or Better Bet pays 12 to 1 on a hand of 4 of a Kind, Straight Flush, 5 of a Kind, Wild Royal Flush or Natural Royal Flush.

16. The method of playing a card game according to claim 14, wherein 4 Of A Kind Or Better Bet pays 1,000 to 1 on a hand of Natural Royal Flush, 100 to 1 on a hand of Wild Royal Flush, 30 to 1 on a hand of 5 of a Kind, 15 to 1 on a hand of Straight Flush, and 4 to 1 on a hand of 4 of a Kind.

17. A method of playing a card game among a plurality of Players and a Banker, each Player wagering against the Banker, the method comprising the following steps:

(a) providing and shuffling at least one standard poker deck of 52, wherein either all Deuces, all Threes, all Fours, all Fives, all Sixes, all Sevens, all Eights, all Nines, all Tens, all Jacks, all Queens, all Kings, or all Aces are wild cards;

(b) each Player placing at least one wager of Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet;

(c) each Player and the Banker are each dealt seven cards and one community card;

(d) determining which dealt hand is assigned to each Player and which dealt hand is assigned to the Banker;

(e) the dealer putting away the Banker's hand in the discard holder;

(f) from each Player's own seven dealt cards and the community card, he or she selecting his or her best 5-card poker hand and discarding three other cards;

(g) determining whether each Player's wager or wagers win or lose, wherein each wild card may be used as any card;

wherein a Player's Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush, and is paid according to a predetermined Aces Two Pair Or Better Bet pay table; the player's said wager loses if the Player's best 5-card poker hand is not one of the aforesaid winning hands;

wherein a Player's 3 Of A Kind Or Better Bet wager wins if said Player's best 5-card poker hand is 3 of a Kind, Straight, Flush, Full House, 4 of a Kind, Straight Flush, 5 of a Kind or Royal Flush, and is paid according to a predetermined 3 Of A Kind Or Better Bet pay table; the player's said wager loses if the Player's best 5-card poker hand is not one of the aforesaid winning hands;

wherein a Player's Straight Or Better Bet wager wins if said Player's best 5-card poker hand is Straight, Flush, Full House, 4 of a Kind, Straight Flush, 5 of a Kind or Royal Flush, and is paid according to a predetermined Straight Or Better Bet pay table; the player's said wager loses if the Player's best 5-card poker hand is not one of the aforesaid winning hands;

wherein a Player's Flush Or Better Bet wager wins if said Player's best 5-card poker hand is Flush, Full House, 4 of a Kind, Straight Flush, 5 of a Kind or Royal Flush, and is paid according to a predetermined Flush Or Better Bet pay table; the player's said wager loses if the Player's best 5card poker hand is not one of the aforesaid winning hands;

wherein a Player's Full House Or Better Bet wager wins if said Player's best 5-card poker hand is Full House, 4 of a Kind, Straight Flush, 5 of a Kind or Royal Flush, and is paid according to a predetermined Full House Or Better Bet pay table; the player's said wager loses if the Player's best 5-card poker hand is not one of the aforesaid winning hands;

wherein a Player's 4 Of A Kind Or Better Bet wager wins if said Player's best 5-card poker hand is 4 of a Kind, Straight Flush, 5 of a Kind or Royal Flush, and is paid according to a predetermined 4 Of A Kind Or Better Bet pay table; the player's said wager loses if the Player's best 5-card poker hand is not one of the aforesaid winning hands;

wherein a Player's Bonus Bet wager wins if said Player's best 5-card poker hand is one of the predetermined Bonus Bet winning hands, and is paid according to a predetermined Bonus Bet pay table; the player's said wager loses if the Player's best 5-card poker hand is not one of the predetermined Bonus Bet winning hands; and (h) settling each Player's wager or wagers against the Banker.

* * * * *